US005581941A

United States Patent [19]

Sill et al.

[11] Patent Number: 5,581,941

[45] Date of Patent: Dec. 10, 1996

[54] VENT AND TILT ROOF WINDOW PROVIDING AN EXIT

[75] Inventors: Michael Sill; Wolfgang Rädle; Harald Tomanek, all of Leinfelden-Echterdingen, Germany

[73] Assignee: Roto Frank AG, Leinfelden-Echterdinger

[21] Appl. No.: 429,179

[22] Filed: Apr. 26, 1995

[30] Foreign Application Priority Data

Apr. 26, 1994 [DE] Germany ..... 9406891 U

[51] Int. Cl.[6] ..... E05D 15/08; E05D 15/20

[52] U.S. Cl. ..... 49/246; 49/251; 49/252

[58] Field of Search ..... 49/246, 248, 250, 49/251, 252, 260, 386

[56] References Cited

U.S. PATENT DOCUMENTS

| | | | |
|---|---|---|---|
| 2,648,878 | 8/1953 | Albano | 49/252 |
| 2,779,069 | 1/1957 | Ziesmer | 49/248 |
| 3,721,044 | 3/1973 | Kvasnes | 49/248 |
| 4,226,002 | 10/1980 | Davis | 48/248 |
| 4,364,201 | 12/1982 | Taylor | 49/248 |

FOREIGN PATENT DOCUMENTS

| | | | |
|---|---|---|---|
| 1160159 | 10/1955 | Germany | 49/246 |
| 2425799 | 12/1975 | Germany | 49/351 |

*Primary Examiner*—Kenneth J. Dorner
*Assistant Examiner*—Curtis Cohen
*Attorney, Agent, or Firm*—Pepe & Hazard

[57] ABSTRACT

The invention concerns a tilting-swinging roof window, in which the window sash (1) is held by two arms (3) mounted to pivot on the upper end of the casement (2). In the swinging movement, the window sash (1) is guided by swivel pins (12) slidable in grooves (9) on the side members (6) of the casing (2). In the tilted position, the sash (1) is tightly connected by the arms (3) to the upper end of the casement (2). The roof window is provided with an opening device, which, in the area of the longitudinal side members of the casement, requires little space, applies force to the window casing as uniformly as possible, and has parts which are largely integrated into existing components. Slides (4) under spring force are guided in tubular arms (3) and swivel-mounted spring arms (5) are located on the side members (6) of the casement (2) so that a plane through the bearings (10, 11) of the spring arms (5) in each case forms an acute-angled triangle with a plane through the bearings (20) of the tubular arms (3) on the casement (2), and the bearings 10.

20 Claims, 7 Drawing Sheets

Fig. 8
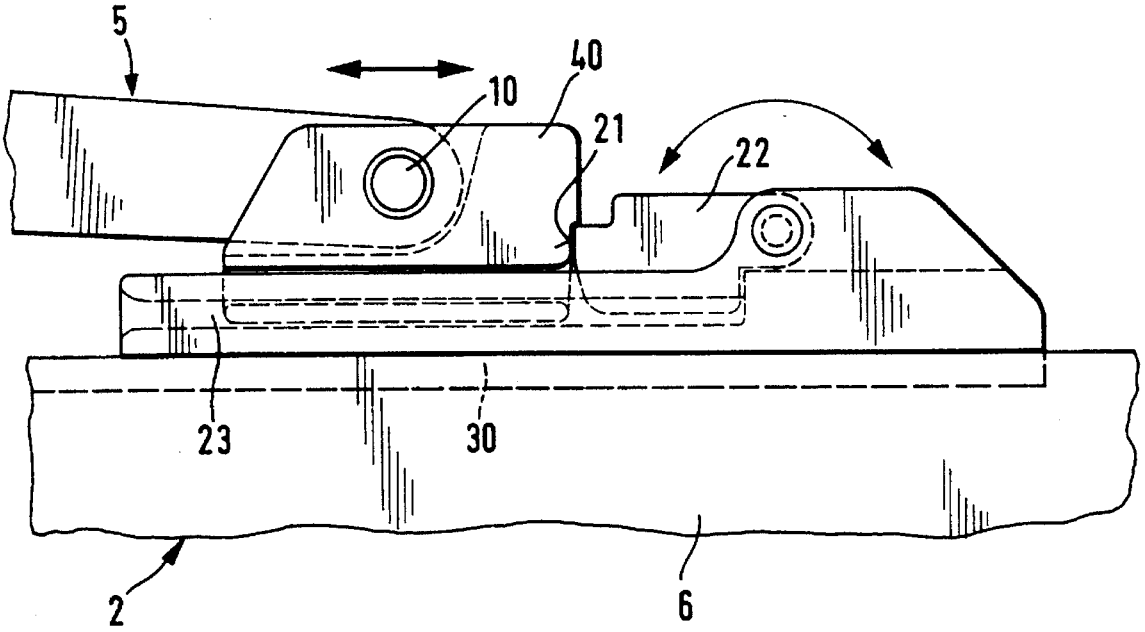
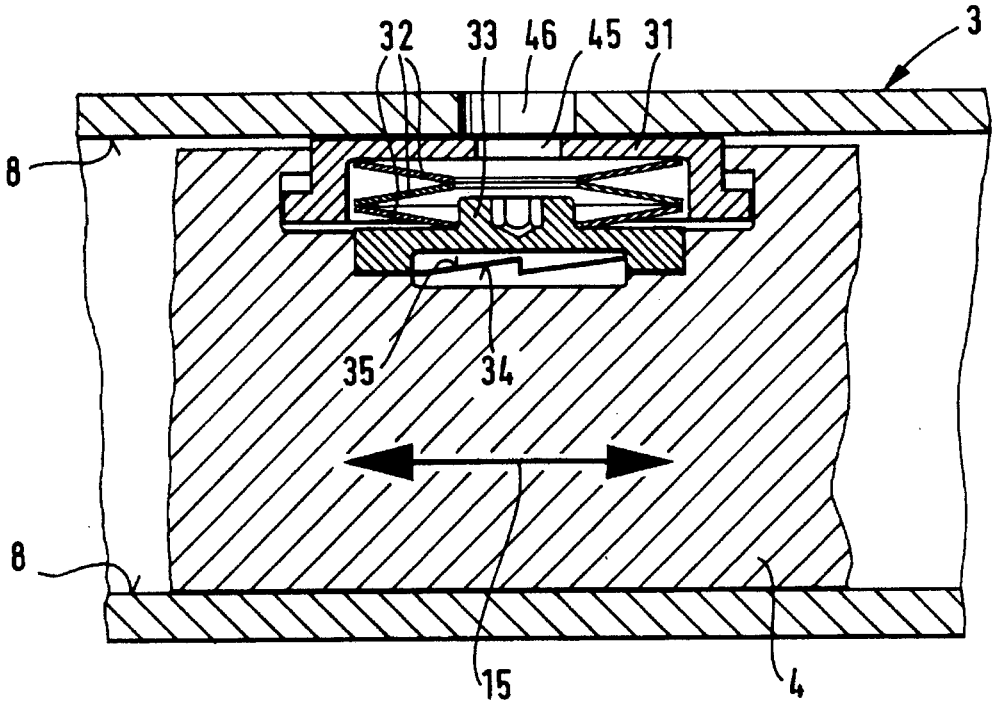
Fig. 9

VENT AND TILT ROOF WINDOW PROVIDING AN EXIT

BACKGROUND OF THE INVENTION

The invention concerns a tilting-swinging roof window with a spring-assisted opening device, in which the window sash is hingedly supported at approximately the middle of the length of its side members on the free end of two arms pivotably mounted on the upper end of the casement and in which the sash is guided in the swinging position by two swivel pins on the side members of the sash which are slidable in grooves on the side members of the casing, and, in the tilting position, of the window sash is fixed on the arms.

A tilting-swinging roof window of this type is known from DE-OS 2 708 785. In the case of this roof window the arms holding the window sash are pushed upwardly by means of two supporting arms which are pivotable on the casing, the spring force being created by spiral springs located on the axis of pivoting thereof. Since, with increasing opening of the sash, the point of application of the working force of the supporting arms on the holding arms shifts in the direction to the upper end of the casing, the lever ratio becomes more unfavorable with increasing opening of the window. Therefore, strong spiral springs have to be used, which leads to the fact that the sash does not remain in a desired position in the case of small opening angles and therefore more favorable lever ratios, but automatically opens further. The supporting arms with the spiral springs require a relatively great amount of space on the casing. Since the grooves for guiding the swivel pins are located on the casing, the supporting arms have to be mounted in an area above the grooves. However, this arrangement again leads to increasingly unfavorable lever ratios.

SUMMARY OF THE INVENTION

The invention is based on the task of providing a tilting-swinging roof window of the type mentioned initially with an opening device, which does not need a lot of room in the area of the longitudinal member of the casing, acts on the window sash with force as uniformly as possible, and has parts which are integrated into existing components as much as possible.

The task is solved in accordance with the invention by the fact that slides guided on the tubular arms are biased by spring force in the direction of the free end of the tubular arms and they can move into the area of the tubular arms adjacent to the upper end of the casing. Spring arms connecting the slides and the associated side member of the casing are located so that a plane through the bearing point on the side of the slide and the bearing point on the side of the casing in forms an acute-angled triangle with a plane through the bearing point of the spring arm to the casing and the bearing for the tubular arm on the casing. The distance between the bearing points of the spring arm, respectively the distance of the bearing point of the arm from the bearing point of the spring arm on the casing side is a multiple of the distance between the bearing points of the arm from the bearing point of the spring arm on the sash side.

This solution has the advantage that, outwardly of the bearing point of the spring arm, no components of the opening device are located on the longitudinal member of the casing. Therefore there is space for a lengthened design of the slide rail for guiding the swivel pins, and it is possible to provide the slide rail with additional functions. The free space created is available also for measures for transporting the window sash safely or for fixing the sash in the open position. The slides and the springs are covered since they are enclosed in the tubular arms and thus are protected from dirt and weather influences.

The claimed arrangement of the bearing points of the spring arms as well as the bearing points of the arms holding the sash produces lever ratios which, even in the case of a wide open window sash, lead to sufficient forces for counterbalancing the window sash and enable a wider opening. In the case of a greater opening of the window sash, decreasing spring force and more favorable lever ratios compensate each other so that a somewhat uniform exertion of force over a wide range of opening of the window sash is ensured by the opening device.

It is advisable to locate the bearing point of the arms to the casing on a projection which extends in the direction of the casing.

An essential task of the invention consists in the creation of a blocking capability for the opening device.

This additional task is solved in the case of a tilting-swinging roof window, in which the window sash can be brought into a cleaning position; by swivel pins which slide in the groove on a slide rail set on the front surface of the side members of the casing when they are adjacent to the lower end of the grooves. In this case the lower end of the window sash pointing toward the interior of the room is disposed at an angle of less than 90° with respect to the plane of the casing in the area above the swivel pin. The slides and the arms have apertures which are aligned when the window sash is brought into cleaning position in such a way that a securing bolt can be inserted, and the bearing point on the side of the casing can be moved and fastened along the side member of the casing.

Thus the tilting-swinging roof window can be supplied with a fully functional opening device at the factory, and the spring may be pretensioned. By means of the inserted securing bolt, the slide is limited in its path of motion with respect to the arm holding the window sash. If the slide is adjacent to the securing bolt, the spring force is conducted from the slide directly into the tubular arm. Thus the spring force no longer is transferred into the spring arm and, in spite of a stretched spring, there is at least no significant force acting in the direction of opening of the window sash. If the window sash is unlocked from the casement inadvertently before installation of the roof window into the roof, the sash largely remains on the casing. This avoids the danger of damage to the roof window or the destruction of the window sash, as takes place in the case of the previously known roof windows, in the case of an unintentional opening of the window sash, the spring force causes a spontaneous, abrupt opening of the window sash, resulting in a significantly safety risk. The blocking arrangement provides transportation and accident protection.

In addition, in particular after the installation of the casement in the roof, the additional attachment of the window sash on the arms is made easier. In the case of a blocked spring force, the arms remain lying on the front face of the casing because of the lack of a spring force acting on the spring arms. When the window sash for example is connected with the arms by the swinging bearing attached on the free end of the arms, no spring forces interfere with the required handling of the arms. The blocking arrangement thus facilitates the installation of the window sash in the casement already inserted in the roof and acts as an installation aid.

The aperture in the arm advantageously is made as a hole and that in the slide as a slot. In this way the securing bolts can be inserted over a wide range of opening positions of the window sash to the casing, so that no exact centering of the arrangement is necessary.

The fixed attachment of the movable bearing point of the spring arm on the casement can be raised by having the bearing point of the spring arms guided longitudinally and attached by means of removable stops for swivelling the arms for tilting open, or swinging open, the window sash. In particular, the stops are made as members which can be swivelled into the lower area of the sliding path of the spring arm bearing providing the bearing point.

A significant advantage of this configuration also consists in the fact that the removal of the spring force acting on the spring arm can be achieved simply, rapidly, reliably, and without needing a tool, by pushing on the securing bolt with the spring relaxed, and releasing this spring force by pulling out the securing bolt.

The spring force acting on the spring arms is achieved by means of tension springs which are fastened on the slide and the front free end of the arms, with the tension springs in each case being mounted in the tubular arm. In this way a hollow space provided by the tubular arms, preferably rectangular in cross-section, is used for installing the springs in an enclosed space. As a result, the operator is protected from possible injury from the spring and the spring is largely protected against weather influences.

It is advantageous to mount an adjusting screw for adjusting the spring force on the free end of the arms so that this adjustment can be made from the front side of the free end of the arms, which provides an easily accessible point.

It is advisable for the slides to have increased sliding friction with respect to the arms so that the window sash remains secure in any open position, in particular in the case of the tilt open position. The sliding friction can be increased by coating the slide with plastic or locating a brake block, which is pressed by means of a spring, between the slide and the arm bearing the window sash.

For better adjustment to the different cases of installation of the tilting-swinging roof window in the roof, it is preferable to make the sliding friction of the slide adjustable. This may be done for example by installing a brake block between the slide and the inner walls of the arms forming the guides for the slides, and the brake block is adjustable by means of a compression spring and a vertically adjustable adjusting element. In this case the brake block can be mounted in the slide or in the holding arm. The adjusting element can consist of a screw or be made as a washer which can be turned by means of a tool and which has inclined planes which coact with inclined counterplanes located on its place of application. The fact that the friction effect can be adjusted makes it possible to perform readjustment and individual adjustment in order to match the respective installation conditions.

In order to be able to remove the tension springs from the arms holding the window sash in a simple way, for example in order to replace them, it is proposed that the tension springs be mounted on the slide by means of a screw which is accessible through an opening in the arm when the spring is untensioned.

In order to simplify the assembly of the components of the opening device to be attached to the casement, it is advisable to locate a reinforcing rod connecting the bearing point of the spring arms on the casement, and this reinforcing rod simultaneously transfers the forces proceeding from the window sash and the opening device uniformly into the casing with a reduction of the specific force loading.

If the goal is to make a window which cannot be opened too wide, it is proposed that the tubular arms have a slot on the underside for the entrance of the spring arm the length of which can be changed in length by means of a plate mounted on the arm in order to limit the range of opening of the window sash. In this way the opening angle of the window sash can be limited, which limitation can be made infinitely variable if the plate is mounted so that it can be moved and secured in adjusted positions on the arm.

BRIEF DESCRIPTION OF THE DRAWINGS

The drawings serve for a further explanation of the invention, and a specific embodiment is shown schematically.

FIG. 8 shows an enlarged view the area of the bearing position of the spring arm on the casing; and FIG. 9 shows a sectional view of a slide with a brake block.

DETAILED DESCRIPTION OF THE ILLUSTRATED EMBODIMENT

Figure 1:
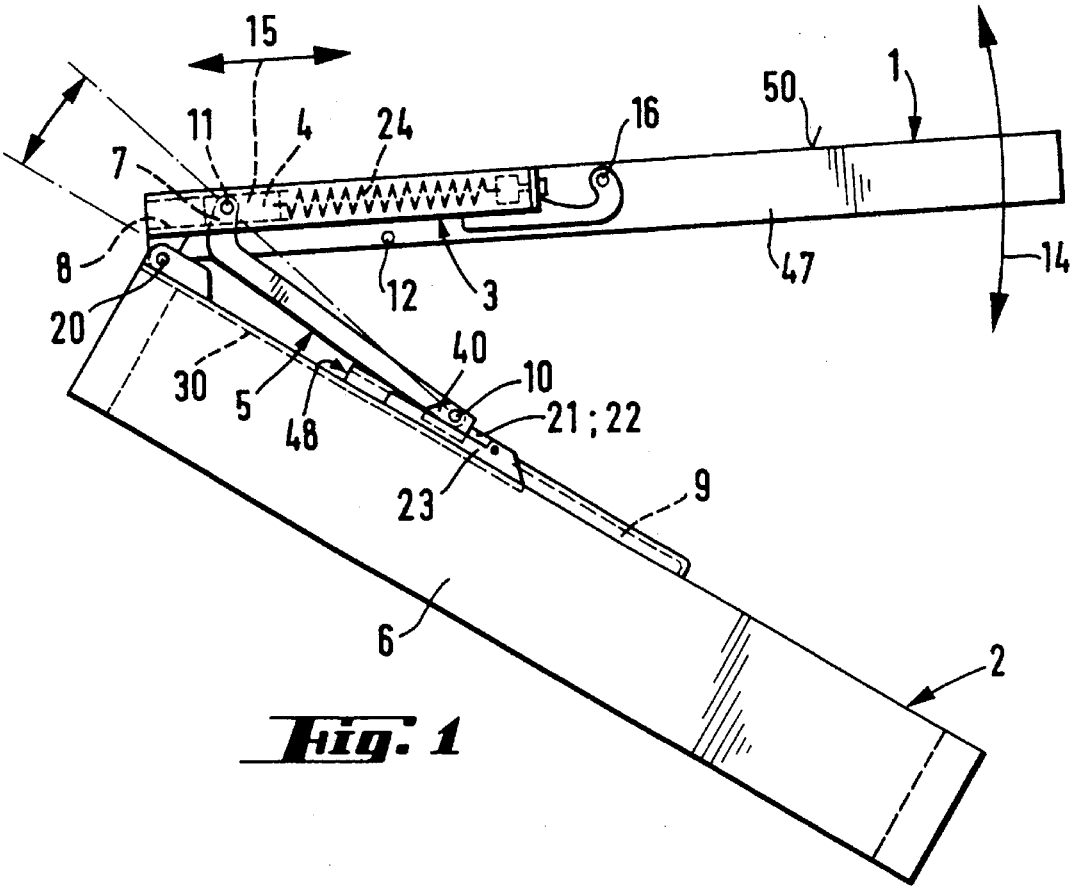
FIG. 1 shows a tilting-swinging roof window in the tilted open position of the window sash.
Figure 2:
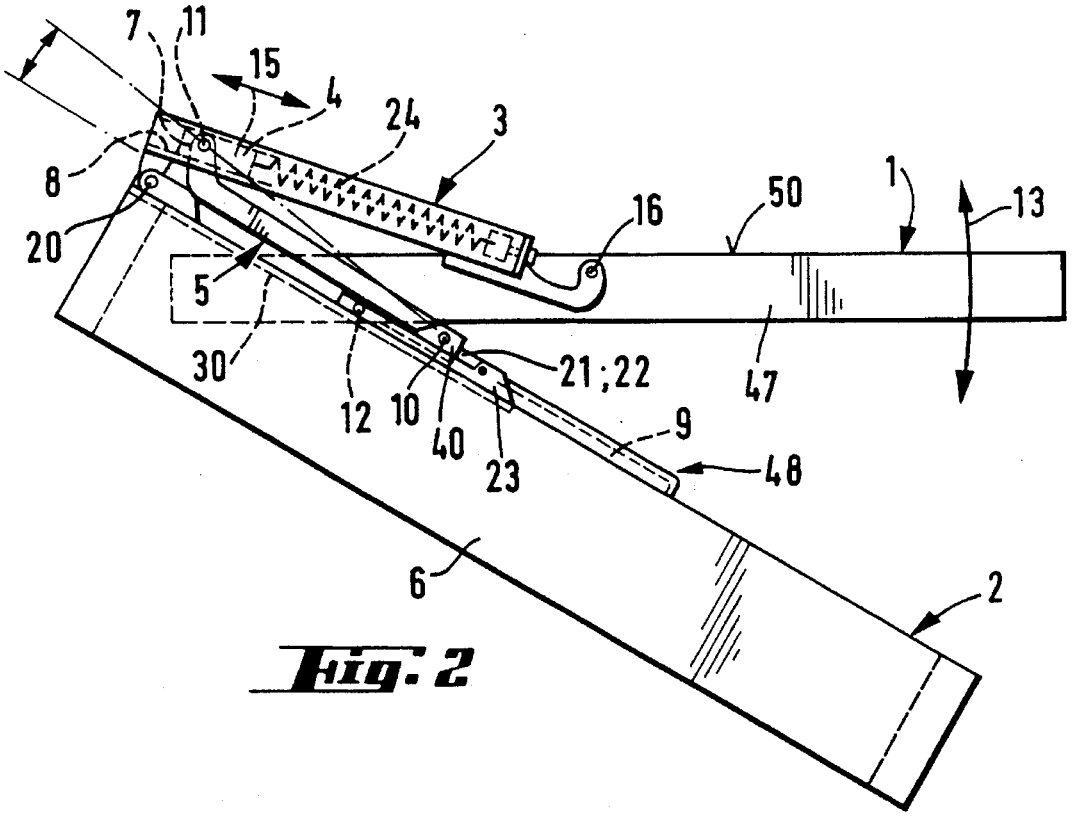
FIG. 2 shows the tilting-swinging roof window in the swing open position.

The tilting-swinging roof window of FIGS. 1 and 2 consists of the casement 2 on which a window sash 1 is pivoted by means of the arms 3. Each arm 3 is pivotably connected to the upper end of the casement 2 at the bearing point 20. The free end of the arm 3 bears a swinging bearing 16 on which the window sash 1 is held by the arms 3 approximately in the area of the middle of the side rails 47. An opening device, supported by spring force, essentially consists of a spring arm 5 and a tension spring 24 which is mounted inside the tubular arm 3 which has a generally rectangular cross section. The spring 24 is coupled with a slide 4, which also is located within the arms 3, and it is guided so that it can move along the inner walls 8 of the arms 3. The spring arm 5 has an upwardly extending ear 7 on the upper end, and it is connected to the slide at the bearing point 11. The spring arm 5 Is connected at its lower end to the side member 6 of the casement 2 at the bearing point 10. The bearing point 20 of the arm 3 is fastened in fixed position on the casement 2, while the bearing point 10 of the spring arm 5 is mounted so that it can be moved, but it also can be fixed in place on the same side member 6 of the casement 2. The bearing point 11 of the spring arm 5 located on the slide 4 is movable with the slide 4 in both directions of the arrow 15.

In FIG. 1, the window sash 1 is coupled to the arms 3 so that the window sash 1 and arms move synchronously to the tilted open position, and in particular around the tilt axis formed by the bearing point 20. The directions of the tilting motion of the window sash is designated by the double headed arrow 14.

In order to be able to bring the window sash 1 into a swung open position as shown in FIG. 2, the coupling between the upper end of the window sash 1 and the arms 3 is released and then the window sash 1 is opened. On the side rails 47 of the window sash 1 in the upper third of its length is a swivel pin 12 which slides in a groove 9 of a slide bar 48 mounted on the front side of the side member 6 of the casing 2. In the swing opening movement of the window sash 1, the swivel pin 12 slides in the groove 9 downwardly. In this way the lower ends of the arms 3 are moved outwardly from the casement 2 and an expanding angle is formed between the upper portion of the window sash 1 and the arms 3. Increased headroom is created when the swing bearing 16 is raised from the casement 2. The swinging movement of the window sash 1 around the swing bearing 16 connecting the window sash 1 and arms 3 is represented by the bidirectional arrow 13.

Figure 3:
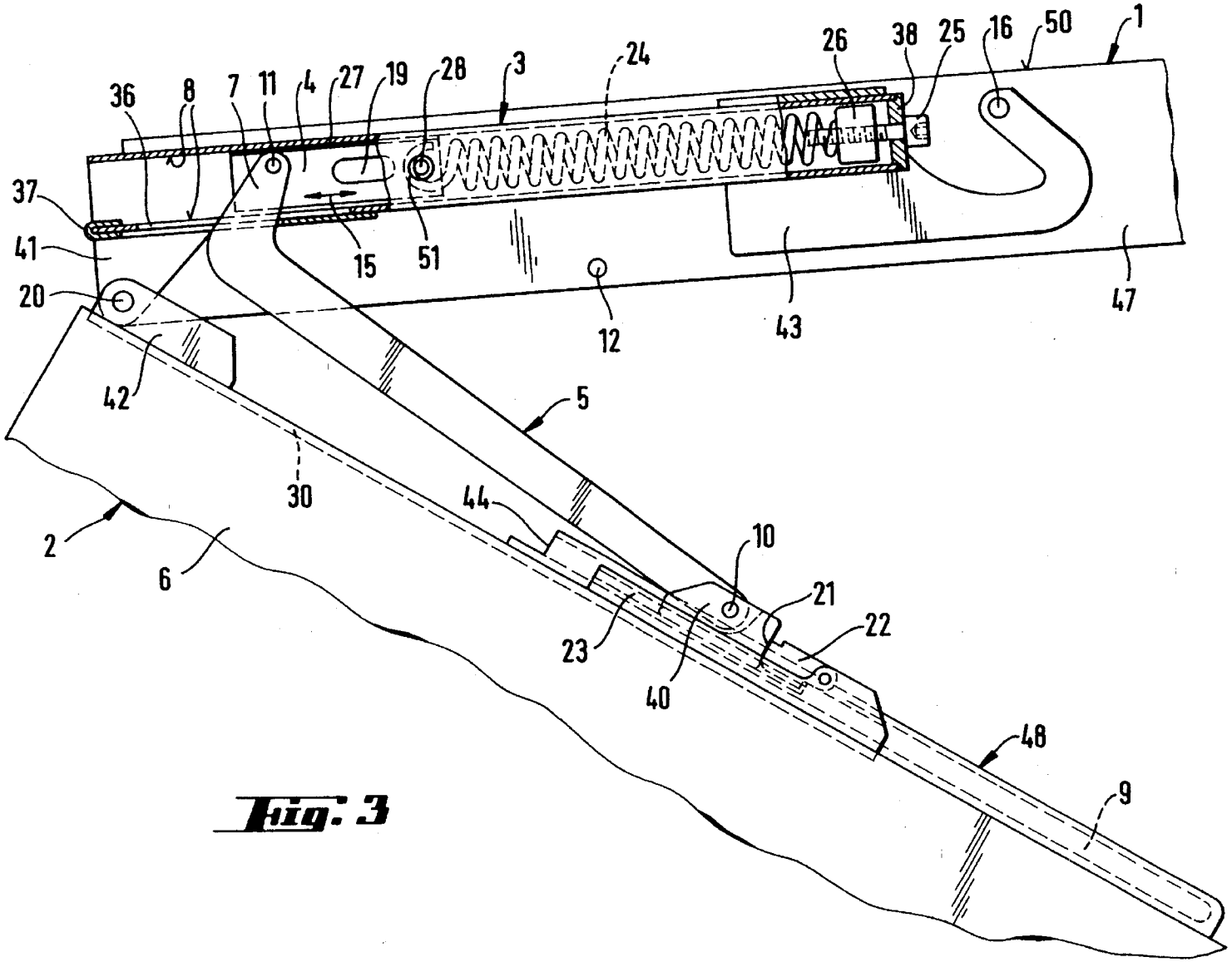
FIG. 3 is an enlarged view of a section of the window in FIG. 1.

The distance between the bearing points 20 and 11 is kept relatively small, as may be seen in FIG. 3, in order not to increase the construction height of the window sash frame, which is covered by a window cover plate. As a result of the short distance of these bearing points 20 and 11 from one another the spring arm 5 between its bearing points 10, 11, is a multiple of this short distance, as is the length of the distance between the bearing points 10, 20 on the side of the casement 2. There is a small acute angle between a plane passing through the bearing points 10, 20, and a plane passing through the bearing points 10, 11. This acute angle causes lever arm ratios which result in a uniform harmonic force in the movement of the window sash 1 when a sufficient force is exerted by the tension springs 24.

In the interior of the tubular arm 3 which has a rectangular cross-section, the slide 4 is guided by the inner walls 8. Preferably, the slide 4 has a plastic-coated surface in order to increase friction. The slide 4 is located in a forward position to be shifted against the swing bearing 16 when the window sash is in the tilted open position. The spring arm 5 is connected with the slide 4 by the bearing point 11 on the ear 7 which extends through a slot 36 in the underside of the arm 3 to engage the spring arm 5. The tension spring 24 is held on the slide 4 by means of a screw 28 accessible through an opening 51 in arm 3. An external screw part 26 is secured on the front end of the tension spring 24. The adjusting screw 25 is screwed into this external screw part 26. The adjusting screw 25 is supported with its screw head on a spring bearing 38, which is at the free end of the tubular arm 3. The spring tension can be adjusted at any time by operating the adjusting screw 25, and the use of a socket head cap screw ensures good engagement. In the tilted-open position of the window sash 1 shown, the tension spring 24 is relatively relaxed. Depending ear 41 on the upper or casement end of the arm 3 extends in the direction of the casement 2 and provides the bearing point by which it is mounted on the casement 2. The distance from the bearing pin 20 to bearing point 11 is so great that, when the window sash 1 lies against the casement 2, the spring arm 5 and holding arm 3 lie over one another in the same plane. Further, this results in lever ratios which ensure that, even when the window sash 1 lies against the casement 2, sufficient forces act in the opening direction so that the window sash 1 can be moved upwardly easily from the beginning of the opening motion.

The spring arm 5 is swivelled on the side member 6 of the casement 2 at the bearing point 20. The bearing point 10 is part of the spring arm bearing 40, which is movable in a guide rail 23, as is shown in FIG. 8. The path of motion in the direction of the lower part of the casement 2 can be limited by means of a removable stop 21 which is located on the front side of a pivotable member 22, which in turn is mounted to swivel on the guide rail 23.

Stabilization of the mechanism and relief of the force on the casement 2 can be achieved by means of a reinforcing rod 30 which connects the tilt bearing 42 providing the bearing point 20 for the connection with the guide rail 23 which also holds the spring arm bearing 40.

The arms 3 have upstanding connecting ears 43 on their free ends on which are located the swing bearings 16 which form the suspension for the window sash 1.

In order to limit the tilt open width of the window sash 1, at least one of the two arms 3 holding the window sash 1 is mounted so that it moves on a plate 37 to change the effective length of the slot 36 in the arm.

FIGS. 3 to 7 also show the interaction of the swivel pin 12 with the slide bar 48 on the side of the casement. Each swivel pin 12 is located in an area between the middle and the upper end of the side rail 47 and they are disposed outwardly on both sides of the window sash 1 in alignment with one another. In the case of the swinging motion of the window sash 1, these swivel pins 12 are guided in the grooves 9 which are located in slide bars 48 set on the face side of the side members 6 of the casement 2.

Figure 4:
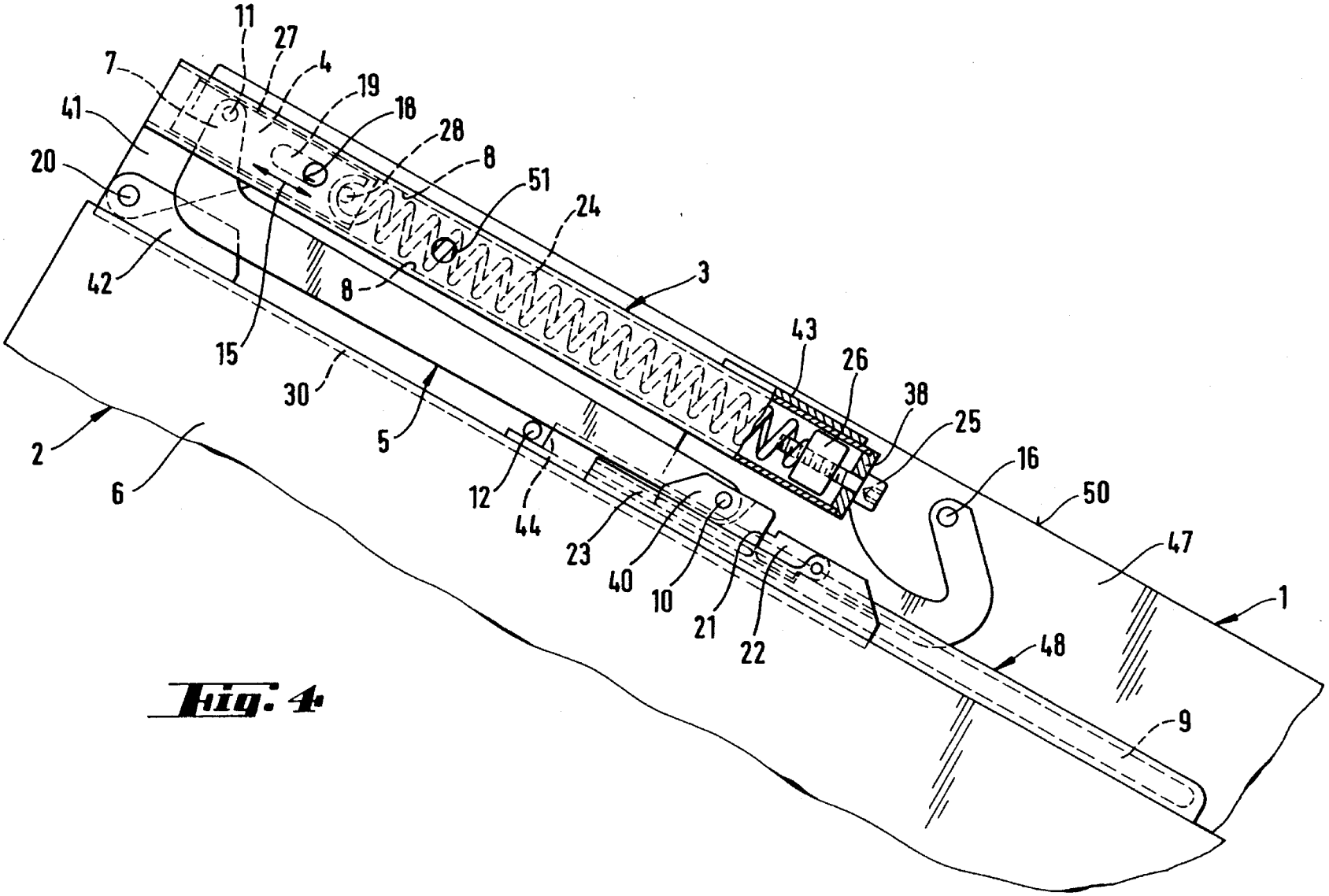
FIG. 4 shows the section of FIG. 3 with the window sash in the closed position.

In FIG. 4, the window sash 1 is located on the outer face of the casement 2. It can be located in a closed position latched with the casement 2. In this case, the slide 4 is pushed into its uppermost position by means of the spring arm 5, and the tension spring 24 assumes its most extended position and exerts the greatest spring force. In this way, the tension spring 24 stores the force which is necessary for supporting the sash in an open motion.

Figure 6:
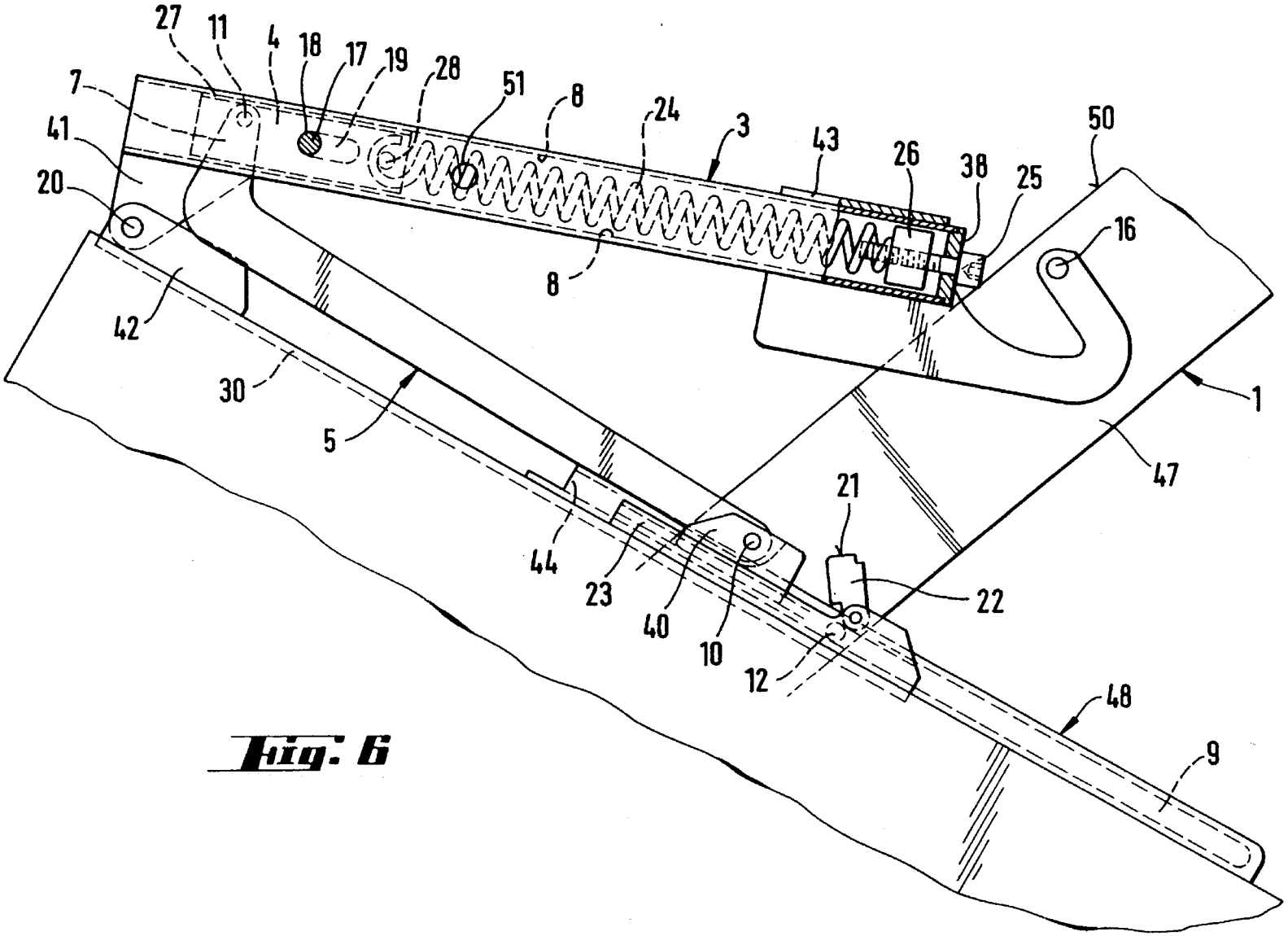
FIGS. 6 and 7 show the steps necessary for releasing the blocking arrangement.
Figure 7:
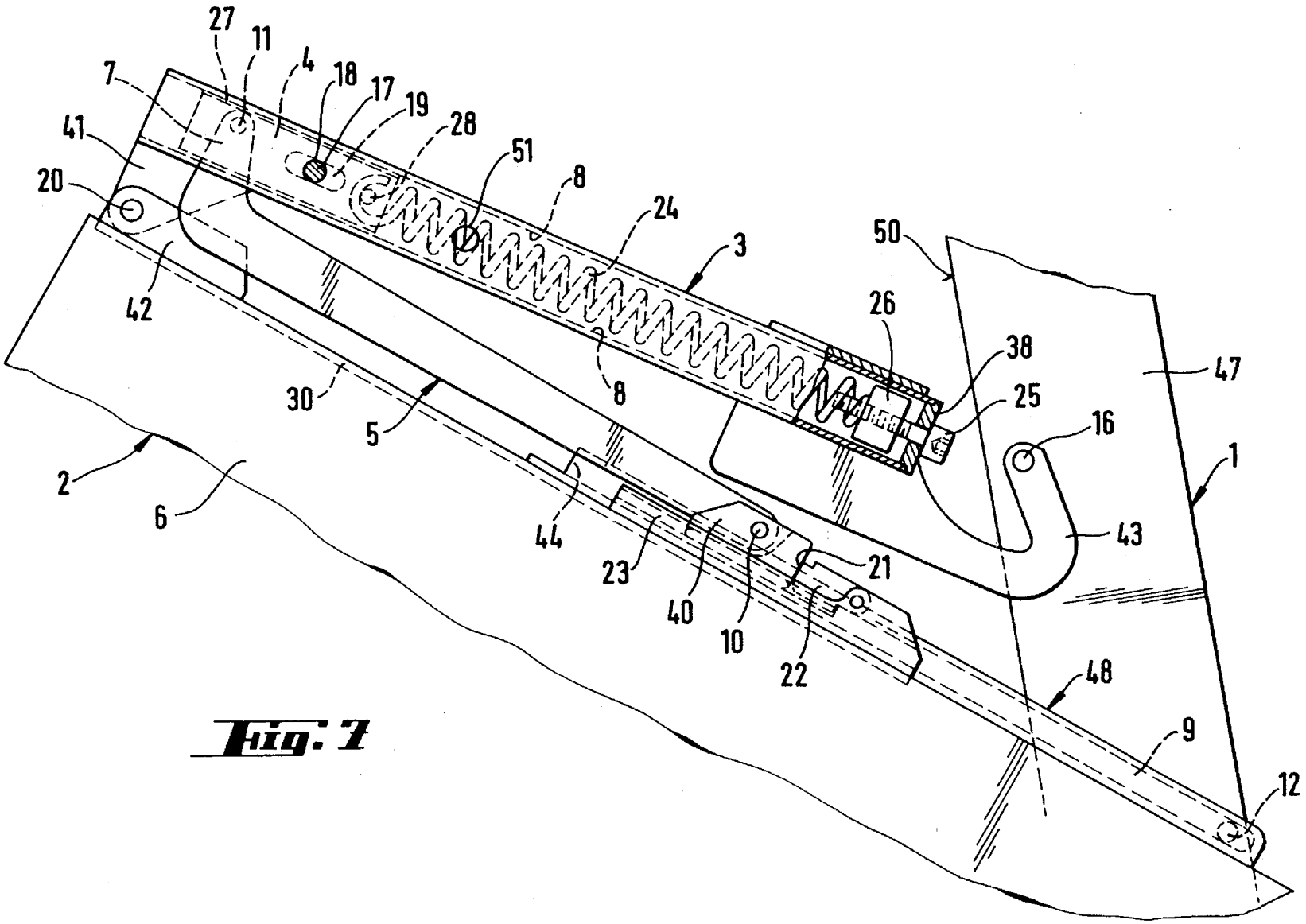

The swivel pins 12 lie opposite an opening 44 in the upper end of the groove 9 in the slide bar 48. If the window sash 1 is tilted open, these swivel pins 12 move along the slide bar 48 having the groove 9 unhindered into the position shown in FIG. 3. In this case the arms 3 are coupled releasably with the window sash 1 by means of a latch element and the window sash 1 moves synchronously with the arms 3 while avoiding a swinging motion around the swinging bearings 16. If the window sash 1, starting from the position in FIG. 4, is to be moved into a swinging position, the attachment between the window sash 1 and the arms 3 first must be released. The opening motion of the window sash 1 in connection with a swinging motion around the swinging bearing 26 on the arms 3 ensures that the swivel pins 12 enter the opening 44 of the groove 9 in the slide bar 48 and move downwardly in this groove 9, as is shown in FIGS. 6 and 7 by two different stages in the swinging open of the window sash 1.

FIG. 4 further shows a slot 19 located in the slide 4 and holes 18 which do not overlap each other and which extend through both walls of the arm 3. When the slot 19 in the slide 4 is aligned with the holes 18 in the arm 3, a securing bolt 17 is inserted therethrough in order to block the spring force of the tension spring 24, as is shown in FIG. 5.

Figure 5:
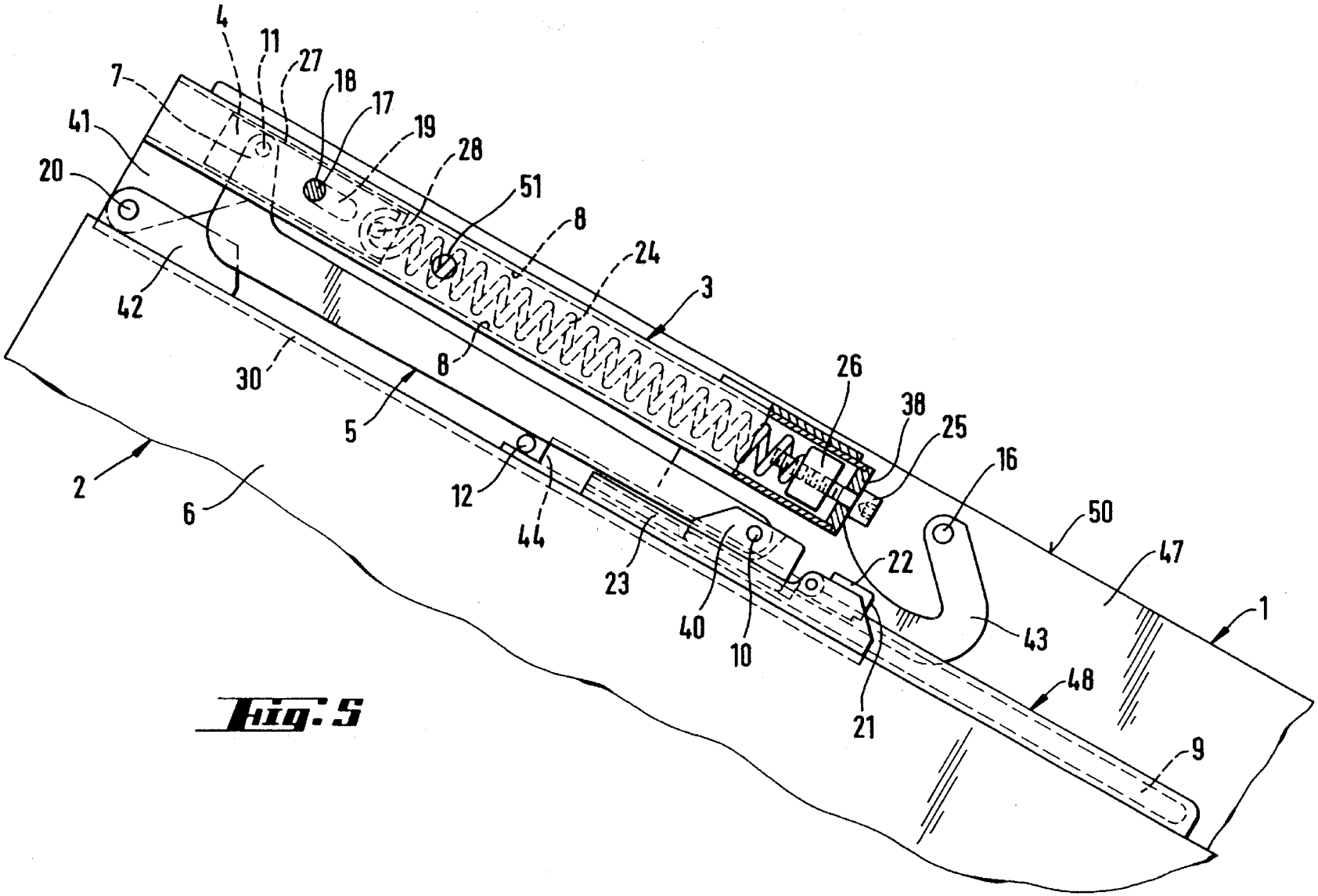
FIG. 5 shows the blocking device of the opening device with the spring force removed from the spring arm.

In FIG. 5, the window sash 1 is closed and latched in the casement 2. On each arm 3 of the tilting-swinging roof window is a securing bolt 17 which has a head which serves as a stop to limit its insertion; the bolt 17 is inserted through the holes 18 and the slot 19. The slide 4 is pulled under the influence of the spring force of the tension spring 24 in the direction of the free end of the arm 3 until the securing bolt 17 adjacent the bearing point 11 reaches the end of the slot 19. The spring force now is transferred to the securing bolt 17 from the slide 4 via the end of the slot 19 and from there to the arm 3 and can no longer act on the spring arm 5.

In addition, the bearing point 10 of the spring arm on the side member 6 of the casement 2 is provided with an attachment which can be removed. The spring arm 5 is mounted so that it can swivel on the spring arm bearing 40, which in turn is mounted so that it is capable of moving longitudinally in the guide rail 23. A pivotable member 22 is located on the lower end of the guide rail 23 and provides a stop surface 21 when pivoted forwardly to the position seen in FIG. 8. When the securing bolt 17 is not pushed inwardly, the spring force of the tension spring 24 also acts on the spring arm bearing 40 which is supported on the stop 21 of the member 22 under tension. Longitudinal displacement of the slide 4 within the arms 3 and thus a change in the length of the tension spring 24 takes place as a result of the offset of the bearing points 11, 20 in the pivoting of the arms 3 about the fixed support of the bearing points 20 and 10. The fastening of the slide 4 with respect to the arm 3 precludes this movement of the slide 4 when the securing bolt 17 is inserted. If pivoting the arms 3 takes place with the securing bolt 17 inserted, this now causes an oscillating pushing motion of the spring arm bearing 40 of the spring arm 5, and the spring arm bearing 40 moves away from the stop 21 of the flap 22 and also moves back to it. The distance between the spring arm bearing 40 and the member 22 is chosen so that, when the member 22 is swiveled towards the upper end of the casement 2, the stop 21 lies within the path of motion of the spring arm bearing 40; when the member 22 is pivoted in the opposite direction, the spring arm bearing 40 is free to move over its entire possible path of motion.

When the member 22 is swivelled away and a securing bolt 17 is inserted as is shown in FIG. 5, the spring force of the tension spring 24 is completely neutralized in its effect on the window sash 1. In the event of an unintentional unlatching of the window sash 1 from the casement 2, the window sash 1 does not move away from the casement 2 so that there is protection for the assembly during transportation and safety from accidental injury before the installation of the roof window.

With the securing bolt 17 inserted and the flap 22 is swivelled into the path of motion of the spring arm bearing 40 as is shown in FIG. 7, a part of the path of motion of the spring arm bearing 40 is blocked. In this way, a part of the spring force created by the tension spring 24 is transferred to the window sash 1. In the case of an intentional unlocking of the window sash 1, it will open only slightly, and the opening motion takes place gently and slowly.

In the cleaning position of the window sash 1 shown in FIG. 7, the outside surface 50 of the window sash 1 is accessible from the inside of the room. The tension spring 24 is relaxed, the slide 4 is pushed away from the free end of the arms 3, the securing bolt 17 is located in the middle of the slot 19, and the spring arm bearing 40 is under tension at the stop 21 of the flap 22 which is swivelled into the path of motion. In this position, the tension of the securing bolt 17 with respect to the slot 19 is removed and the spring force no longer acts on the securing bolt 17. Now the securing bolt 17 can be removed conveniently, and without great force, and by hand.

When the window sash 1 is released from the cleaning position the spring force is reactivated by stretching of the tension spring 24 in combination with the support of the spring arm bearing 40 on the stop 21 of the flap 22. The tilting-swinging roof window now is in the use position as installed in the roof.

FIG. 9 shows a design of an arrangement for the adjustable regulation of the sliding friction force between the slide 4 and arm 3. A vertically adjustable brake block 31 is inserted in the slide 4, and the brake block 31 is pushed against the inner surface 8 of the arms 3 by the plate spring 32. In addition there is a disk-shaped adjusting element 33 with inclined planes 34 in a circular form located on the disk surface, and the planes 34 interact with corresponding inclined counterplanes 35 on the slide 4. The adjusting element 33 can be turned by a tool, for example a hex head wrench, with a hole 45 in the brake block 31 providing accessibility. The arm 3 also has a hole 46 which is positioned so that the hole 45 aligns with this hole 46 in the swung wide open position of the window sash 1. The controllable adjustment of the sliding friction to brake the motion of the slide 4 with respect to the surface wall 8 of the arm 3 makes it possible to adjust to individual requirements, installation conditions, or weather influences, and readjustment may be effected as required.

Having thus described the invention, what is claimed is:

1. A tilting-swinging roof window with a spring-assisted opening device comprising:

(a) a window sash (1) having upper and lower ends and side rails (47) extending therebetween;

(b) a casement (2) for said sash (1) and having upper and lower members and side members (6) extending therebetween;

(c) a pair of tubular arms (3) pivotably connected at one end to said upper members of said casement (2) at bearing points (20) and at their other end to said side rails (47) of said sash (1), said sash (1) being guided in its swinging movement by swivel pins (12) mounted on said side rails (47) of said sash (1) and slidable in grooves (9) on said side members (6) of said casement (2), said sash (1) pivoting relative to said arms about said pins (12) in the swinging position and being attached to and pivoting with said arms (3) in the tilting position of said window sash (1);

(d) a pair of slides (4) slidably guided in said tubular arms (3) adjacent said upper member of said casement (2) and biased in the direction of said other end of said tubular arms (3); and (e) spring arms (5) connecting said slides (4) and said side members (6) on said casement (2) with a bearing point (11) on said slide (4) and a bearing point (10) on a side member (6) of said casement (2), the distance between said bearing point (10) of said spring arm with said casement (10) and said bearing point (20) of said tubular arm with said casement being a multiple of the distance between said bearing point (11) of said spring arm with said slide in said sash and said bearing point of said tubular arm with said casement, an imaginary plane through the bearing point (10) of said spring arm with said casement and the bearing point (20) of said tubular arm with said casing forming an acute angle with an imaginary plane through the bearing point (10) of said spring arm with said casement and the bearing point (11) of said spring arm with said sash.

2. A tilting-swinging roof window in accordance with claim 1 wherein said bearing point (20) of said arms (3) is on said casement (2) is disposed on a depending ear (41).

3. A tilting-swinging roof window in accordance with claim 1 wherein said window sash (1) can be swung into a cleaning position on said side member of said casement (2), said window additionally including slide bars (48) mounted on the front surface of said side members (6) of said casement (2) and providing said grooves, said swivel pins (12) being mounted adjacent the lower surface of said side members (47) of said sash, the plane of the outside surface (50) of said window sash (1) being disposed at an angle of less than 90° with respect to the plane of said casement (2) in the area above said swivel pins (12), said slides (4) and said arms (3) having openings therein which, when said window sash (1) is in the cleaning position, are aligned and into which securing bolts (17) are insertable, and wherein said bearing point (10) of said spring arm (5) on said casement (2) can be moved and fastened along said side member (6) of said casement (2).

4. A tilting-swinging roof window in accordance with claim 3, wherein said perforation in said arm (3) is a hole (18) and said opening in said slide (4) is a slot (19).

5. A tilting-swinging roof window in accordance with claim 3 wherein removable stops are provided in said slide bar grooves (9) and said bearing point (10) of said spring arm (5) on said casement (2) is movable longitudinally and positioned by said removable stops (21) between one position for swivelling the arms (3) to tilt said window open, and a second position for swinging open said window sash (1).

6. A tilting-swinging roof window in accordance with claim 5, wherein spring arm bearing elements (4) are slidable in said grooves of said slide bars (48) and wherein said stops (21) are provided by pivotable members (22) which can be pivoted into the lower area of the sliding path of said spring arm bearing elements (40) slidable in said slide bars (48) and having said bearing points (10) thereon.

7. A tilting-swinging roof window in accordance with claim 1, wherein the spring force acting on said spring arms (5) is created by tension springs (24) mounted in said slides (4) and on said other end of said arms (3) and wherein said tension springs (24) are disposed in said tubular arms (3).

8. A tilting-swinging roof window in accordance with claim 1, wherein an adjusting screw (25) is mounted on said other end of said arms (3) for adjusting the spring force.

9. A tilting-swinging roof window in accordance with claim 1, wherein said slides (4) have increased sliding friction with respect to said arms (3).

10. A tilting-swinging roof window in accordance with claim 9, wherein said slides (4) have plastic-coated surfaces to increase said sliding friction.

11. A tilting-swinging roof window in accordance with claim 9, wherein a brake block (31) is disposed between said slide and said arm (3), and a spring (32) biases said brake block (31) against said arm (3).

12. A tilting-swinging roof window in accordance with claim 1, wherein there is included means for adjusting the sliding friction of said slide (4).

13. A tilting-swinging roof window in accordance with claim 12, wherein there is included a brake block (31) in said tubular arms (3) between said slide (4) and the surface (8) of said arms (3) bounding said groove (9), said brake block (31) being adjustable by means of a spring (32) and a vertically adjustable adjusting element (33).

14. A tilting-swinging roof window in accordance with claim 13, wherein said brake block (31) is mounted in said slide (4).

15. A tilting-swinging roof window in accordance with claim 13, wherein said brake block (31) is mounted in said arm (3).

16. A tilting-swinging roof window in accordance with claim 13, wherein said adjusting element (33) is annular and can be rotated by a tool, said annular adjusting element (33) having inclined surfaces (34) on one surface thereof which cooperate with inclined counterplanes located at the mounting point.

17. A tilting-swinging roof window in accordance with claim 13, wherein said adjusting element (33) consists of a screw.

18. A tilting-swinging roof window in accordance with claim 7, wherein said tension springs (24) are fastened to said slide (4) by a screw (28) which is accessible through an opening (51) in said arm (3) when said tension spring (24) is relaxed.

19. A tilting-swinging roof window in accordance with claim 1, wherein there is included a reinforcing rod (30) extending between the bearing point (20) of said tubular arm (3) on said casement (2) and the bearing point (10) of said spring arm (5) on said casement (2).

20. A tilting-swinging roof window in accordance with claim 1, wherein said tubular arm (3) has a slot (36) on its underside into which said spring arm (5) enters for engagement with said slide (4), said slot being variable in its longitudinal dimension by means of a plate (37) movably mounted on said tubular arm (3) and thereby limits the tilted opening width of said window sash (1).

* * * * *

UNITED STATES PATENT AND TRADEMARK OFFICE

CERTIFICATE OF CORRECTION

PATENT NO. : 5,581,941

DATED : December 10, 1996

INVENTOR(S) : Michael Sill et al

It is certified that error appears in the above-indentified patent and that said Letters Patent is hereby corrected as shown below:

Column 9, Line 16, delete "perforation" and insert --opening--.

Signed and Sealed this

Twenty-fifth Day of March, 1997

*Attest:*

*Attesting Officer*

BRUCE LEHMAN

*Commissioner of Patents and Trademarks*